US007530717B2

(12) United States Patent
Magisano et al.

(10) Patent No.: US 7,530,717 B2
(45) Date of Patent: May 12, 2009

(54) RECESSED LIGHT CAN HEIGHT ADJUSTMENT

(75) Inventors: Antonio Magisano, Vaughan (CA); Yong Wang, Markham (CA)

(73) Assignee: Genlyte Thomas Group LLC, Louisville, KY (US)

( * ) Notice: Subject to any disclaimer, the term of this patent is extended or adjusted under 35 U.S.C. 154(b) by 43 days.

(21) Appl. No.: 11/672,143

(22) Filed: Feb. 7, 2007

(65) Prior Publication Data

US 2008/0186718 A1 Aug. 7, 2008

(51) Int. Cl.
*F21V 15/00* (2006.01)

(52) U.S. Cl. ..... 362/365; 362/147; 248/343

(58) Field of Classification Search ..... 362/364, 362/365, 366, 147, 149, 150; 248/318, 343
See application file for complete search history.

(56) References Cited

U.S. PATENT DOCUMENTS 2,063,923 A * 12/1936 Gries ..... 220/3.6
2,744,716 A * 5/1956 Zingone ..... 248/318
2,965,348 A * 12/1960 Gerstel et al. ..... 248/343
4,048,491 A 9/1977 Wessman
4,449,687 A 5/1984 Karaktin
4,497,014 A 1/1985 Woloski et al.
4,673,149 A 6/1987 Grote et al.
4,705,255 A 11/1987 Reed, Jr.
4,733,339 A 3/1988 Kelsall
4,803,603 A 2/1989 Carson
4,829,410 A 5/1989 Patel
4,887,196 A 12/1989 Brown et al.
5,031,084 A 7/1991 Russo et al.
5,057,979 A 10/1991 Carson et al.
5,068,772 A 11/1991 Shapiro et al.
5,077,650 A * 12/1991 Cestari ..... 362/365
5,124,901 A 6/1992 Sojka et al.
5,222,800 A 6/1993 Chan et al.
5,317,493 A 5/1994 Muller et al.
5,374,812 A 12/1994 Chan et al.
5,377,088 A 12/1994 Lecluze
5,420,775 A 5/1995 Kusmer
5,452,816 A 9/1995 Chan et al.
5,562,343 A 10/1996 Chan et al.
5,588,737 A 12/1996 Kusmer
5,609,414 A * 3/1997 Caluori ..... 362/366
5,725,302 A 3/1998 Sirkin
5,746,507 A 5/1998 Lee
5,902,035 A * 5/1999 Mui ..... 362/267
5,931,432 A * 8/1999 Herold et al. ..... 248/343
5,957,572 A 9/1999 Wedekind et al.
5,957,573 A 9/1999 Wedekind et al.
5,964,523 A * 10/1999 Eversberg ..... 362/365
6,000,818 A 12/1999 Caluori (Continued)

*Primary Examiner*—Sandra L. O'Shea
*Assistant Examiner*—Gunyoung T. Lee
(74) *Attorney, Agent, or Firm*—Chad D. Bruggeman; Middleton Reutlinger

(57) ABSTRACT

A recessed down lighting system having an adjustable retaining bracket. The adjustable retaining bracket facilitates attachment of a reflector to ceilings, walls, or the like of variable thicknesses. The recessed down lighting system may be installed in locations having reduced overhead space above the ceiling or where minimal lateral clearance is available behind the ceiling. The retaining bracket and fastener can be installed and vertically adjusted through the open end of the reflector to secure the reflector to the ceiling.

26 Claims, 5 Drawing Sheets

U.S. PATENT DOCUMENTS 6,132,069 A * 10/2000 Sato et al. ..... 362/365
6,272,794 B1 8/2001 Rippel et al.
6,369,326 B1 4/2002 Rippel et al.
6,402,112 B1 6/2002 Thomas et al.
6,415,270 B1 7/2002 Rackson et al.
6,421,904 B1 7/2002 Wedekind et al.
6,471,374 B1 10/2002 Thomas et al.
6,554,458 B1 * 4/2003 Benghozi ..... 362/365
6,632,006 B1 10/2003 Rippel et al.
6,779,908 B1 8/2004 Ng
6,994,457 B2 2/2006 Lee
7,331,555 B2 * 2/2008 St-Pierre ..... 248/343
2003/0115767 A1 6/2003 Wedekind et al.
2008/0068847 A1 * 3/2008 Bedard ..... 362/365

* cited by examiner

RECESSED LIGHT CAN HEIGHT ADJUSTMENT

TECHNICAL FIELD

The present invention relates to a recessed down lighting system and particularly to a recessed down lighting system with an adjustable retaining bracket.

DETAILED DESCRIPTION

Recessed down lighting systems, generally known as "pot lights" are commonly used in residential and commercial premises. A disadvantage of current pot lights is that installation can be difficult or impracticable in locations having reduced overhead space above ceilings or where minimal lateral clearance is available behind the ceiling.

Figure 1:
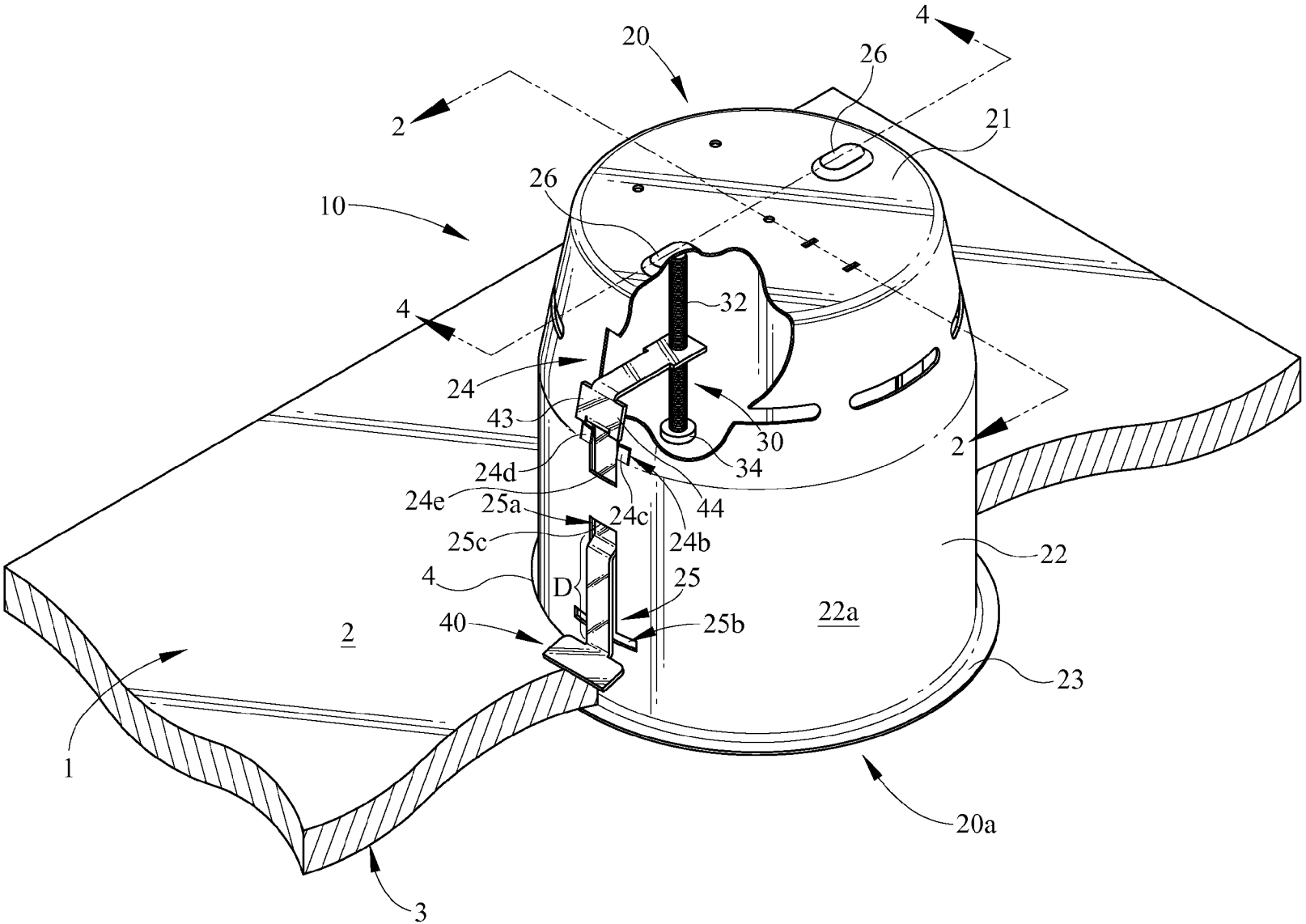
FIG. 1 is a top perspective view of a reflector of a recessed down lighting system engaging a ceiling partially broken away and the reflector partially broken away illustrating the retaining bracket and fastener.
Figure 5:
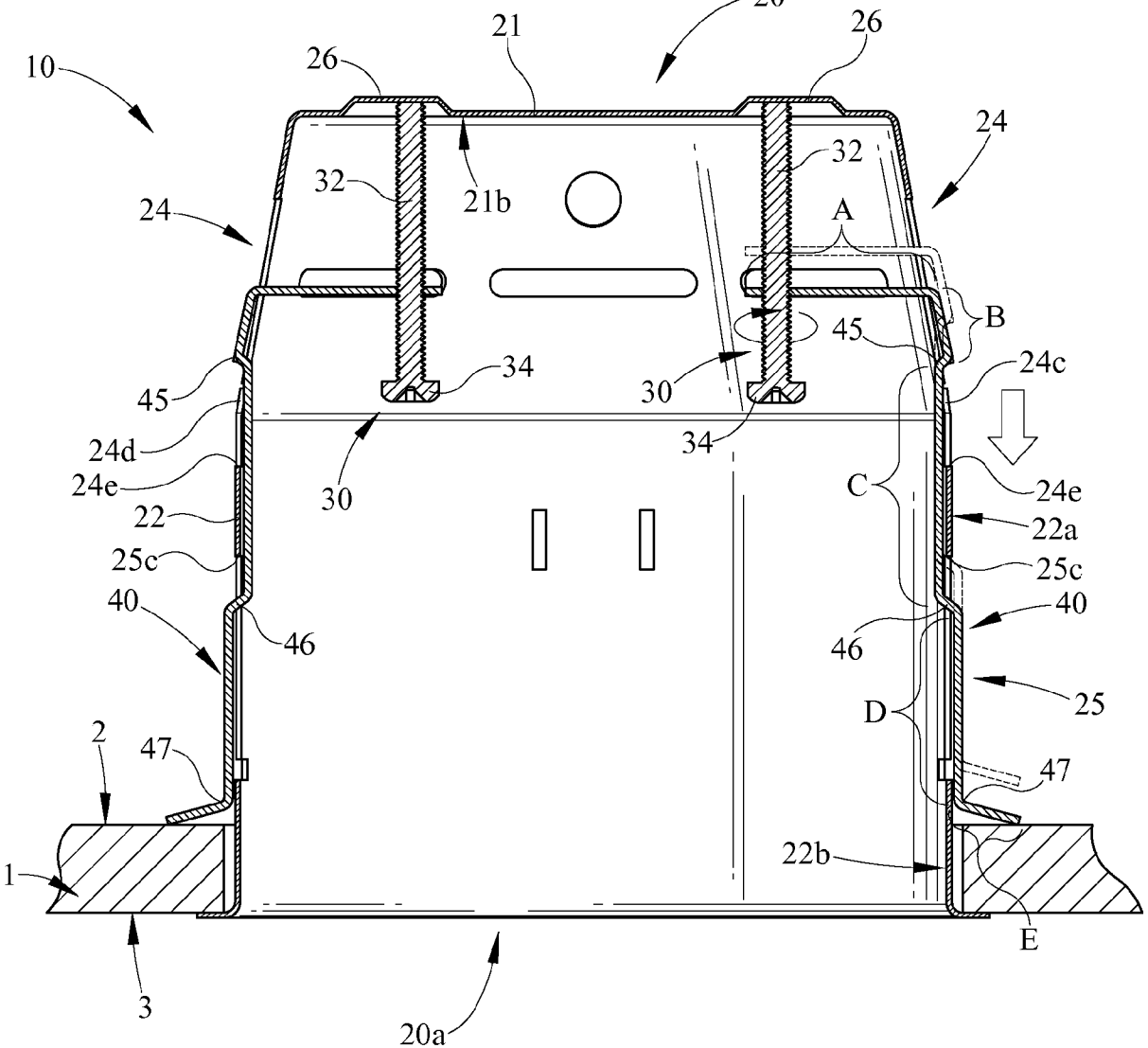
FIG. 5 is a sectional view of the recessed down lighting system of FIG. 1 taken along line 4-4 showing the vertical positioning of the bracket at a disengaged position (dotted lines) and at an engaged position with the ceiling (full lines).

A shown in FIG. 1, recessed down lighting system 10 according to one embodiment of the present invention depicted in the drawings comprises a cylindrical reflector 20 or housing secured in a recessed position within a ceiling 1 or similar structural surface, by at least one adjustable retaining bracket 40. The retaining bracket 40 may be moved vertically by means of a threaded adjustment fastener 30 or biasing member within reflector 20 between a disengaged position and an engaged position with the ceiling as shown in FIG. 5. More specifically a cylindrical reflector 20, which is usually composed of but not limited to aluminum, has a reflector peripheral flange 23 flaring out from the sidewall 22 at opening 20*a* of reflector 20. Reflector 20 will also contain an electrical socket for a floodlight, halogen bulb or other electric lamp, which is inserted into the socket through opening 20*a* of the reflector.

Figure 2:
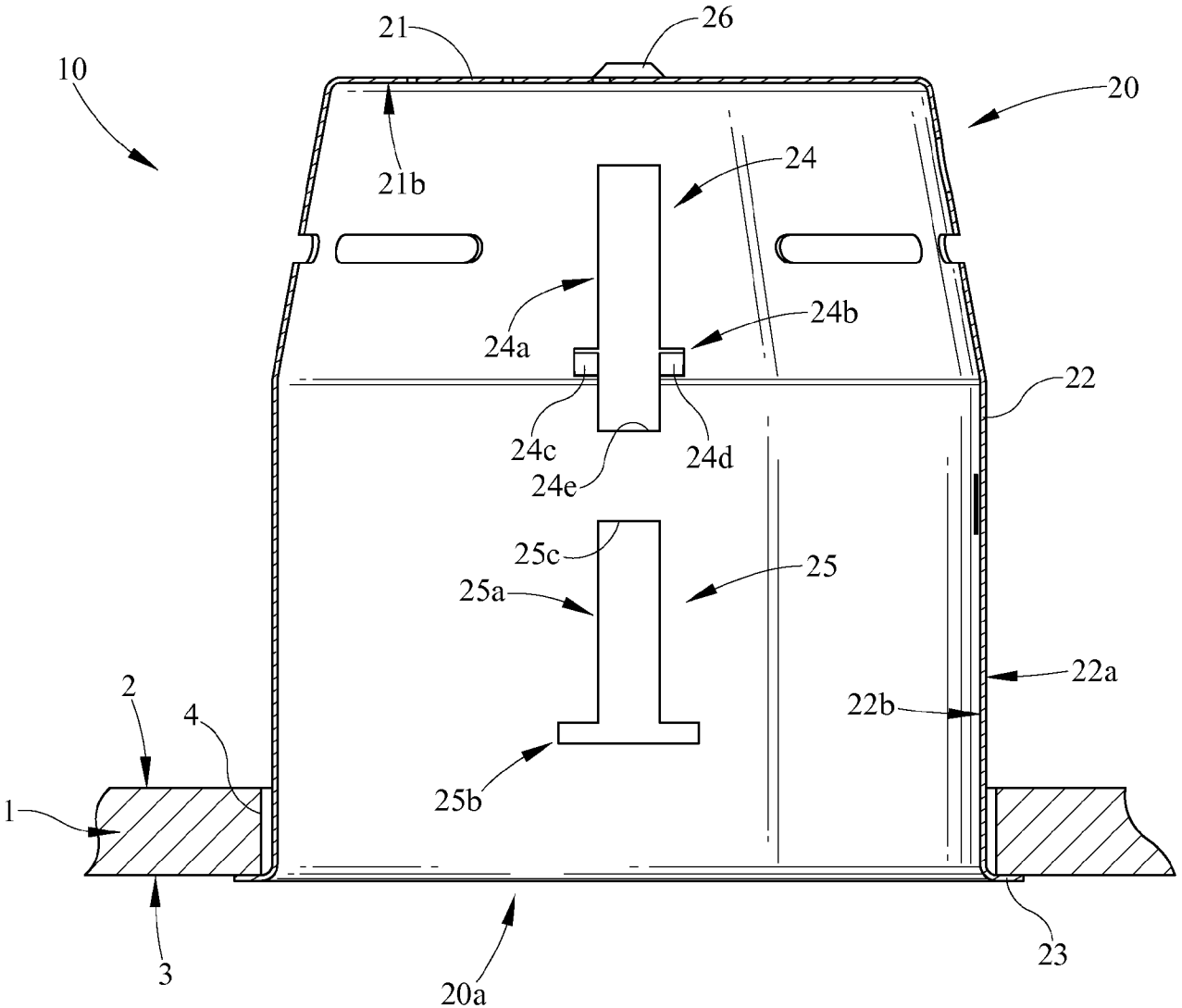
FIG. 2 is a sectional view of the reflector of FIG. 1 taken along line 2-2 with the retaining bracket and fastener removed.
Figure 3:
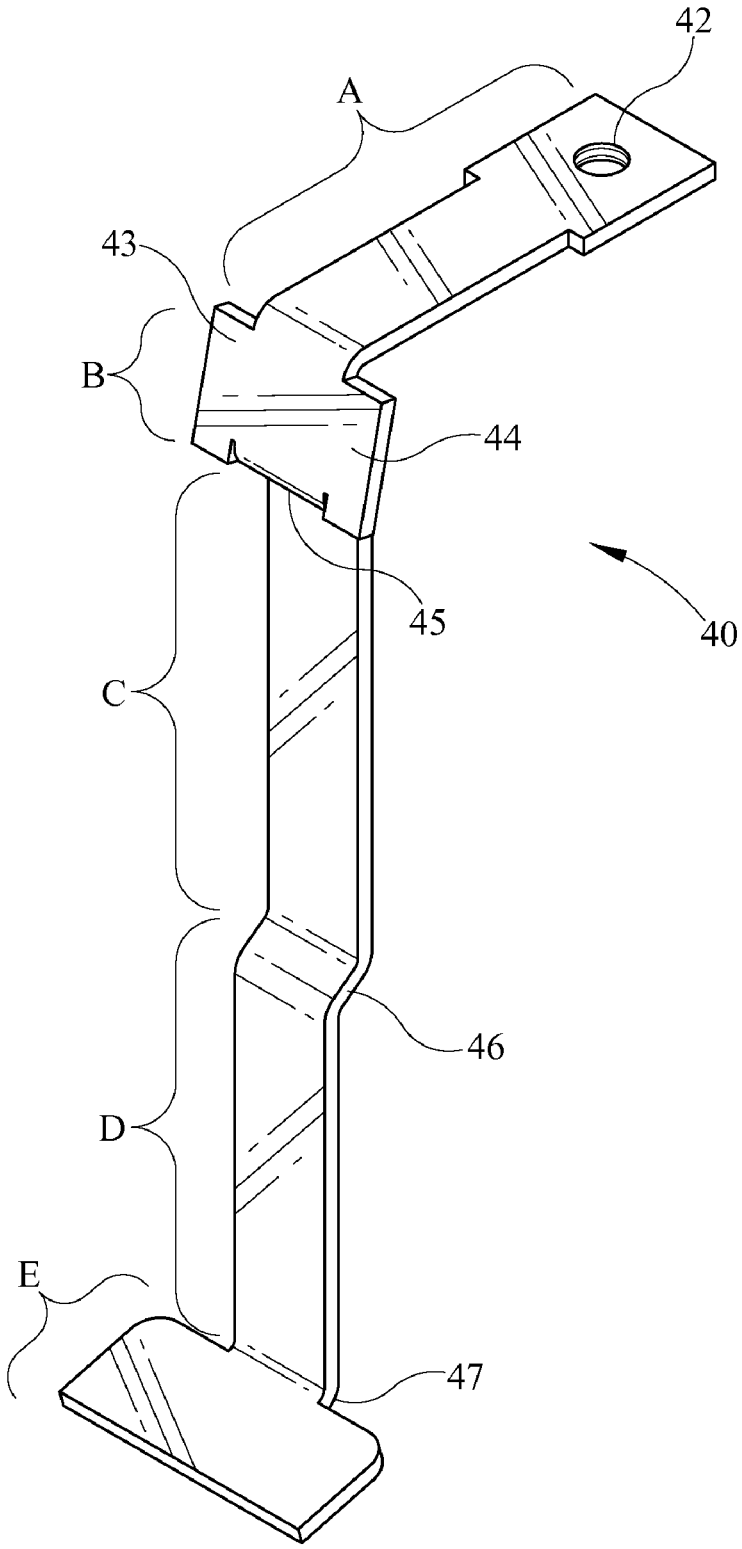
FIG. 3 is an enlarged perspective view of the bracket of FIG. 1.
Figure 4:
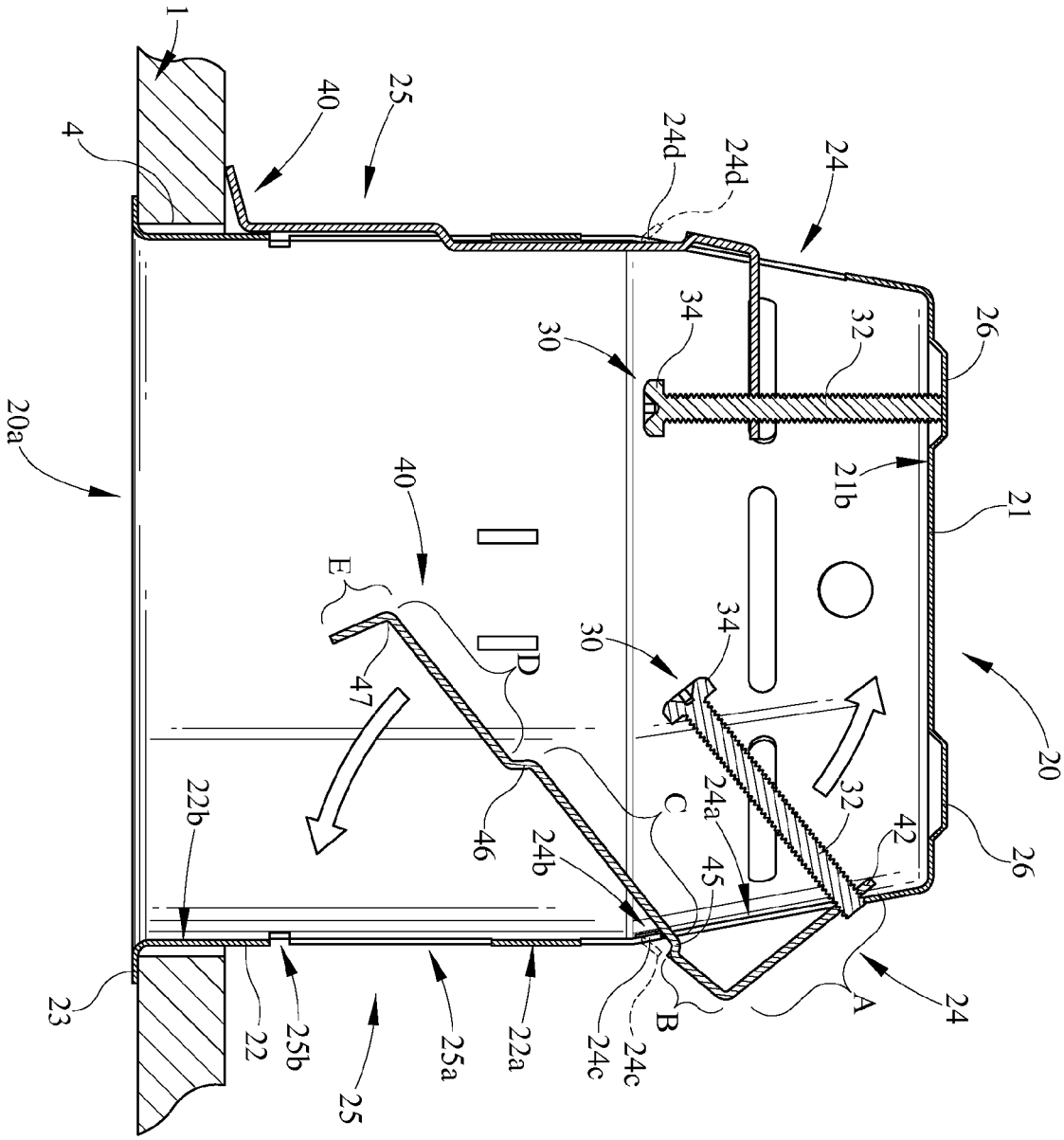
FIG. 4 is a side sectional view of the recessed down lighting system of FIG. 1 taken along line 4-4 showing the bracket being inserted into the slots of the reflector, showing the positioning of the bendable tabs at an open position (dotted lines) and at a closed position (full lines) with the upper horizontal slot of the sidewall.

As shown in FIGS. 1, 2, 4, and, 5, reflector 20 will be recessed into a ceiling opening 4 or aperture of ceiling 1 for use. Reflector 20 has a top wall 21 with depending, cylindrical sidewall 22 which extends through ceiling opening 4. Peripheral flange 23 of sidewall 22 is adapted to engage an outside surface 3 of ceiling 1 adjacent ceiling opening 4. Peripheral flange 23 is disposed over and serves to hide any irregularities in ceiling opening 4, thereby presenting a seamless transition between flange 23 and outside surface 3 of ceiling 1. While flange 23 has been shown to be continuous, it may be discontinuous, that is formed in segments which substantially surround the open end of reflector 20. Also, while reflector 20 has been shown as having a circular cylindrical configuration, it will be understood by those skilled in the art that square or rectangular cylindrical or other shaped reflectors could also be used.

As shown in FIGS. 1, 2, 4, and 5, reflector 20 has at least one set of vertically aligned slots in sidewall 22. A first, upper slot 24 is vertically disposed above a second, lower slot 25. Before positioning retaining bracket 40 into sidewall 22, an opposing first bendable tab 24*c* and a second bendable tab 24*d* project, as shown in FIG. 4, from an edge of upper slot 24 defining an upper horizontal slot 24*b* or entry channel in sidewall 22. Upper slot 24 comprises an upper vertical slot 24*a* intersected by the now present upper horizontal slot 24*b* which is positioned closer to the bottom end of the upper vertical slot. Lower slot 25 comprises a lower vertical slot 25*a* intersected by a lower horizontal slot 25*b* at the bottom of lower vertical slot 25.

As shown in FIGS. 1, 3, 4, and 5, lighting system 10 typically contains two retaining brackets 40, although one, or more than two brackets 40 may be used as needs require. Each bracket 40 has an elongated body or sliding section having at respective ends thereof, an upper portion A or biasing flange and a lower flange portion E or compression flange, both substantially parallel to each other but projecting laterally from bracket 40 in opposing directions from each other. Sliding section includes, but is not limited to, portions B, C, and D. Upper portion A contains a threaded aperture 42 therethrough. Depending from upper portion A is a second portion B having a first projection 43 and a second projection 44 extending laterally from each edge thereof. A first bent portion C, having a substantially U-shaped cross section, depends from portion B and is connected to portion B by a flange 45 which is bent back as shown in FIG. 4, to laterally offset portion C from portion B. Depending from first bent portion C is a second bent portion D which is connected to portion C by a flange 46 bent forward to laterally offset portion D from portion C. Portion C is connected to lower flange portion E at bend 47, and lower flange portion E projects from second bent portion D at an angle which is typically obtuse. It should be understood to those skilled in the art, each portion of bracket 40 may be a variety of shapes, sizes, and configurations with sidewall 22 and still function within the scope of the embodiments to engage and disengage from the ceiling.

As shown in FIGS. 1, 4, and 5, recessed down lighting system 10 also comprises a fastener 30 or biasing member used in combination with each retaining bracket 40. Fastener 30 typically includes an elongated threaded stem 32 connected to a head 34. Head 34 is accessible for manual or powered ratcheting through reflector opening 20*a*. As shown in FIGS. 4 and 5, elongated threaded stem 32 threadably engages through threaded aperture 42 of bracket 40. Various screws, bolts and other fasteners or similarly functioning bias means known to those skilled in the art may be used and still be within the embodiments of the invention.

Bracket 40 can be inserted through opening 20*a* of reflector 20 and manipulated into its proper position. From inside the reflector 20, upper portion A of bracket 40 is inserted through upper vertical slot 24*a* of upper slot 24 until second portion B with projections 43 and 44 is positioned in and moves completely through upper horizontal slot 24*b*. Subsequently, bracket 40 is shifted up and the bracket may be rotated to move lower flange portion E toward sidewall 22. As shown in 1, 4, and 5 when portion B has been inserted through upper horizontal slot 24*b* or entry channel, the previously projecting bendable protrusions, first tab 24*c* and second tab 24*d*, can be flattened, folded, or bent back into a substantially flush position effectively closing upper horizontal slot 24*b* of sidewall 22. With tabs 24*c* and 24*d* so flattened effectively closing upper horizontal slot 24*b*, bracket 40 cannot be easily removed or fall-out of upper slot 24. It should be understood to those skilled in the art, bendable protrusions, such as tabs 24*c* and 24*d*, may be in a variety of positions, configurations with retaining bracket 40, sizes, shapes, and quantities and still close off one or more previously opened entry channels which earlier received a portion of bracket 40 effectively securing the bracket to sidewall 22.

As shown in FIGS. 1, 2, 4, and 5, retaining bracket 40 is engaged with sidewall 22 of reflector 20 and acts to secure reflector 20 into its recessed position within ceiling opening 4. With reflector 20 held in its recessed position within ceiling 1, each bracket 40 is shifted up and the bracket is rotated to move lower flange portion E toward lower slot 25 as shown in FIG. 4. Referring to FIG. 1, when bracket 40 is shifted up and rotated, protrusions 43 and 44 will engage and slide up outside surface 22*a* of sidewall 22. Lower flange portion E is then inserted and passed completely through lower horizontal slot 25*b* until second bent portion D protrudes through lower vertical slot 25*a*. Subsequently bracket 40 is shifted vertically down, whereby second bent portion D engages outside surface 22*a* of reflector 20 adjacent and below lower slot 25, and first bent portion C engages inside surface 22*b* between slots 24 and 25 while protrusions 43 and 44 of second portion B continues to engage outside surface 22*a* of sidewall 22. As a result upper portion A of bracket 40 is positioned substantially parallel to top wall 21 inside reflector 20.

As shown in FIGS. 1, 4, and 5, once retaining bracket 40 has been mounted within sidewall 22 as described above, it is capable of being moved vertically from a disengaged position into an engaged position with a top surface 2 of ceiling 1. Each bracket 40 may be adjusted and fixed in an engaged position with ceiling 1 by a means of a fastener 30. Fastener 30 may be threaded through threaded aperture 42 of bracket 40 either before or after bracket 40 has been mounted within sidewall 22. By rotating fastener 30 by means of head 34 the opposite end of elongated threaded stem 32 can be brought into abutment with the inner surface 21*b* of top wall 21, as shown in FIGS. 1 and 5. Inner surface 21*b* may be provided with a recess 26 or the like which will serve to guide and constrain fastener 30 and minimize undesirable shifting of fastener 30 and bracket 40. Continued rotation of fastener 30 will then adjust bracket 40 by moving it vertically along the axis of the fastener until lower flange portion E abuts inside surface 2 of ceiling 1. When one or more brackets 40 are securely engaged to ceiling 1, as shown in FIGS. 1 and 5, reflector 20 will be securely engaged within the ceiling and peripheral flange 23 will be drawn flush with outside surface 3 of ceiling 1.

Although bracket 40 is capable of being moved vertically from a disengaged positioned into and out of an engaged positioned with ceiling 1, the range the bracket may vertically slide may be limited. As shown in FIGS. 1, 2, 4, and 5, bracket 40 may be limited in its downward traveling distance by a lower edge 24*e* of upper slot 24. Lower edge 24*e* interferes with second portion B of bracket 40, thus preventing the bracket from continuing its downward vertical movement. This may prevent retaining bracket 40 from over compressing ceiling 1 while biasing the bracket away from top wall 21. An upper edge 25*c* of lower slot 25 interferes with second bent portion D limiting bracket 40 in its upward vertical movement. Thus after reflector 20 is inserted into opening 4 of ceiling 1, reflector 20 is able to rest upon portion D of one or more brackets 40 until the biasing member or fasteners 30 can be threaded to shift bracket 40 vertically downward into the secured positioned with ceiling 1.

The adjustable nature of retaining bracket 40 facilitates attachment of reflector 20 to ceilings of variable thicknesses while eliminating any need for other types of adjustment structures external to reflector 20. The clearance required above reflector 20 is also minimized by means of the use of the adjustable retaining bracket 40 and fastener 30 of the embodiments of the invention. Since bracket 40 and fastener 30 do not extend above top wall 21 of reflector 20, there is no interference with insulation, floors, other surfaces, heating and air ductwork, or other objects. Also, since bracket 40 does not project in any substantial way through sidewall 22 any intrusion behind the ceiling, or with walls or the like is minimized. Reflector 20 can also be readily removed and relocated without the need for additional fasteners to accomplish the reinstallation, and without damage to the original location. The benefits described above allow for the recessed down lighting system 10 to be installed in locations having reduced overhead space above ceilings or where minimal lateral clearance is available behind the ceiling.

It is understood that while certain embodiments of the invention have been illustrated and described, it is not limited thereto except insofar as such limitations are included in the following claims and allowable functional equivalents thereof.

We claim:

1. A recessed down lighting system comprising:

a housing having a top wall with a depending sidewall;

said sidewall forming an open end, and a peripheral flange substantially surrounding said open end;

at least one bracket having a biasing flange and a compression flange and an interposed sliding section; said sliding section being vertically interwoven in said sidewall; and said sidewall having one or more bendable tabs defining an entry channel, wherein said entry channel is open to permit said at least one bracket to pass through said entry channel when said one or more bendable tabs are folded out of said entry channel and said entry channel is closed when said one or more bendable tabs are folded into said entry channel securing said at least one bracket against said sidewall.

2. The recessed down lighting system as in claim 1 further comprising a biasing member adjustably biasing said biasing flange away from said top wall.

3. The recessed down lighting system as in claim 2 wherein said biasing member contacts an inside surface of said top wall.

4. The recessed down lighting system as in claim 3 wherein said inside surface of said top wall further comprising a recess receiving said biasing member.

5. The recessed down lighting system as in claim 1 wherein said biasing flange projects into said housing, said sliding section engages said sidewall, and said compression flange projects away from said sidewall.

6. The recessed down lighting system as in claim 1 wherein said sidewall has one or more slots receiving said at least one bracket.

7. The recessed down lighting system as in claim 1 wherein said sliding section further comprising one or more protrusions passing through said entry channel when said entry channel is open and secured against the outside of said sidewall when said entry channel is closed securing said at least one bracket against said sidewall.

8. A recessed down lighting system comprising:

a housing having a top wall with a depending sidewall;

said sidewall forming an open end, and a peripheral flange substantially surrounding said open end;

at least one bracket having a biasing flange and a compression flange and an interposed sliding section;

said biasing flange projecting inside said housing, said sliding section engaging said sidewall, and said compression flange projecting away from said sidewall;

said sidewall having one or more bendable tabs defining an entry channel, wherein said one or more bendable tabs being positionable between a closed position and an open position with respect to said entry channel, a portion of said sliding section of said at least one bracket passing through said entry channel when said one or more bendable tabs is in said open position and said one or more bendable tabs being folded into said entry channel when in said closed position securing at least said portion of said sliding section against said sidewall; and a biasing member adjustably biasing said biasing flange away from said top wall.

9. The recessed down lighting system as in claim 8 wherein said biasing member contacts an inside surface of said top wall.

10. The recessed down lighting system as in claim 9 wherein said inside surface of said top wall further comprising a recess receiving said biasing member.

11. The recessed down lighting system as in claim 8 wherein said sliding section being vertically interwoven in said sidewall.

12. The recessed down lighting system as in claim 8 wherein said sidewall having one or more slots receiving said at least one bracket.

13. The recessed down lighting system as in claim 8 wherein said sliding section further comprising one or more protrusions securing said at least one bracket against said sidewall.

14. A recessed down lighting system comprising:

a housing having a top wall with a depending sidewall;

said sidewall forming an open end, and a peripheral flange substantially surrounding said open end;

at least one bracket having a biasing flange and a compression flange and an interposed sliding section;

said sidewall having a first edge disposed above a second edge;

said first edge restricting substantially downward vertical movement of said at least one bracket;

said second edge restricting substantially upward vertical movement of said at least one bracket;

a biasing member adjustably biasing said biasing flange away from said top wall; and wherein said sidewall has one or more bendable tabs defining an entry channel, said one or more bendable tabs are positionable with respect to said entry channel between an open position before assembly of said at least one bracket with said sidewall and a closed position after assembly of said at least one bracket with said sidewall, wherein said at least one bracket being adapted to pass through said entry channel when said one or more bendable tabs is in said open position and said one or more bendable tabs being folded into said entry channel when in said closed position securing said at least one bracket against said sidewall.

15. The recessed down lighting system as in claim 14 further comprising a first slot disposed over a second slot, wherein said first edge coincides with a bottom edge of said first slot and said second edge coincides with a top edge of said second slot.

16. The recessed down lighting system as in claim 14 wherein said biasing member contacts an inside surface of said top wall.

17. The recessed down lighting system as in claim 16 wherein said inside surface of said top wall further comprises a recess receiving said biasing member.

18. The recessed down lighting system as in claim 14 wherein said biasing flange projects into said housing, said sliding section engages said sidewall, and said compression flange projects away from said sidewall.

19. The recessed down lighting system as in claim 14 wherein said sliding section being vertically interwoven in said sidewall.

20. The recessed down lighting system as in claim 14 wherein said sliding section further comprising one or more protrusions positioned outside said sidewall when said one or more bendable tabs are in said closed position with respect to said entry channel securing said at least one bracket against said sidewall.

21. A recessed down lighting system adapted for mounting into an aperture of a ceiling having an inside surface and an outside surface comprising:

a housing mounted within said aperture, said housing having a top wall and a depending sidewall forming an open end opposite said top wall;

a peripheral flange substantially surrounding said open end and engaging said outside surface of said ceiling panel;

said sidewall having a first slot disposed over a second slot;

wherein said first slot has a vertical section and a horizontal section, wherein said horizontal section of said first slot has an opposing first bendable tab and a second bendable tab, wherein each of said first bendable tab and said second bendable tab being positionable between a closed position and an open position with respect to said horizontal section, said first bendable tab and said second bendable tab are folded out of said horizontal section when in said open position and said first bendable tab and said second bendable tab are folded into said horizontal section when in said closed position;

an elongated bracket having a first portion positioned inside said housing substantially parallel to said top wall, a second portion projecting and secured against the outside of said housing when said first bendable tab and said second bendable tab are in said closed position having passed through said first slot when said first bendable tab and said second bendable tab are in said open position, a third portion positioned inside said housing substantially parallel with said sidewall between said first slot and said second slot and a fourth portion projecting outside said second slot;

said fourth portion having an outwardly extending lower flange projecting away from said sidewall; and a biasing member adjustably biasing said bracket away from said top wall.

22. The recessed down lighting system as in claim 21 wherein said first portion has a threaded aperture therethrough and said biasing member having an elongated threaded stem engaging said threaded aperture of said first portion of said bracket, and a free end of said elongated threaded stem adapted to contact an inside surface of said top wall whereby said bracket is positionally adjusted relative to said sidewall by threading said biasing member through said threaded aperture.

23. The recessed down lighting system as in claim 22 wherein said inside surface of said top wall further comprising a recess receiving said free end of said elongated threaded stem.

24. The recessed down lighting system as in claim 21 wherein said biasing member is a screw or bolt.

25. The recessed down lighting system as in claim 21 wherein said second portion of said bracket further comprising an opposing first projection and a second projection engaging an outside surface of said sidewall.

26. The recessed down lighting system as in claim 25 wherein said horizontal section of said first slot being dimensioned to receive said opposing first projection and said second projection of said second portion therethrough when said first bendable tab and said second bendable tab are in said open position.

* * * * *